US010516242B2

(12) United States Patent
Hsu et al.

(10) Patent No.: US 10,516,242 B2
(45) Date of Patent: Dec. 24, 2019

(54) MULTISTAGE SIGNAL TRANSMISSION CONNECTOR

(71) Applicants: Chen-Chien Hsu, Taoyuan (TW); Cheng-Te Hsu, Taoyuan (TW)

(72) Inventors: Chen-Chien Hsu, Taoyuan (TW); Cheng-Te Hsu, Taoyuan (TW)

( * ) Notice: Subject to any disclaimer, the term of this patent is extended or adjusted under 35 U.S.C. 154(b) by 0 days.

(21) Appl. No.: 16/172,930

(22) Filed: Oct. 29, 2018

(65) Prior Publication Data

US 2019/0140407 A1 May 9, 2019

(30) Foreign Application Priority Data

Nov. 9, 2017 (TW) ..... 106138814 A

(51) Int. Cl.

| | |
|---|---|
| ***H01R 24/58*** | (2011.01) |
| ***H01R 13/26*** | (2006.01) |
| ***H01R 13/631*** | (2006.01) |
| ***H01R 13/639*** | (2006.01) |
| ***H01R 13/24*** | (2006.01) |

(52) U.S. Cl.

CPC ..... *H01R 24/58* (2013.01); *H01R 13/2442* (2013.01); *H01R 13/26* (2013.01); *H01R 13/631* (2013.01); *H01R 13/639* (2013.01)

(58) Field of Classification Search

CPC ..... H01R 24/58

See application file for complete search history.

(56) References Cited

U.S. PATENT DOCUMENTS

| | | | | |
|---|---|---|---|---|
| 6,270,380 | B1 * | 8/2001 | Shichida | H01R 13/7031 200/51.1 |
| 6,390,856 | B1 * | 5/2002 | D'Addario | H01R 13/17 439/668 |
| 6,923,687 | B2 * | 8/2005 | Wang | H01R 24/58 439/188 |
| 7,654,872 | B2 * | 2/2010 | Lin | H01R 24/58 439/668 |
| 7,963,784 | B1 * | 6/2011 | Su | H01R 13/703 439/188 |
| 7,963,786 | B1 * | 6/2011 | Su | H01R 24/58 439/271 |
| 7,967,643 | B1 * | 6/2011 | D'Addario | H01R 24/58 439/669 |
| 7,988,498 | B1 * | 8/2011 | Lim | H01R 24/58 439/668 |

(Continued)

*Primary Examiner* — Ross N Gushi

(74) *Attorney, Agent, or Firm* — Alan D. Kamrath; Karin L. Williams; Mayer & Williams PC

(57) ABSTRACT

A multistage signal transmission connector for connecting with a multi-signal plug and a plurality of signal lines includes a socket, a signal terminal unit, and an insertion space. The signal terminal unit is mounted to a side of the socket. The socket includes an axial insertion hole into which the multi-signal plug is inserted. The insertion space is surrounded and defined by the signal terminal unit and extends axially to intercommunicate with the axial insertion hole. The signal terminal unit includes a plurality of signal terminals. Each of the plurality of signal terminals includes a body having an elastic contact portion and an external signal portion. The elastic contact portion protrudes inwards into the insertion space and bends. The external signal portion axially extends towards an outer edge of the insertion space and is electrically connected to the elastic contact portion.

4 Claims, 10 Drawing Sheets

(56) References Cited

U.S. PATENT DOCUMENTS 8,070,528 B2 * 12/2011 Wang ..... H01R 24/58 439/668
8,808,035 B2 * 8/2014 Wu ..... H01R 24/58 439/668
8,951,073 B2 * 2/2015 Zhang ..... H01R 13/64 439/676
9,373,911 B2 * 6/2016 Lo ..... H01R 13/5202
9,583,898 B2 * 2/2017 DeCola ..... H01R 24/58
9,680,264 B2 * 6/2017 Polinski ..... H01R 24/58
9,812,824 B1 * 11/2017 Polinski ..... H01R 24/58
10,074,945 B2 * 9/2018 Polinski ..... H01R 13/746
10,128,585 B1 * 11/2018 Xu ..... H01R 13/7032
10,153,597 B1 * 12/2018 Polinski ..... H01R 13/665
2007/0049124 A1 * 3/2007 Chien ..... H01R 13/629 439/668
2007/0249235 A1 * 10/2007 Wu ..... H01R 13/41 439/668
2008/0280499 A1 * 11/2008 Miki ..... H01R 13/26 439/668
2009/0053922 A1 * 2/2009 Sato ..... H01R 13/641 439/296
2009/0149080 A1 * 6/2009 Wu ..... H01R 12/57 439/668
2009/0291598 A1 * 11/2009 Cheng ..... H01R 13/506 439/668
2009/0298347 A1 * 12/2009 Wu ..... H01R 13/7033 439/668
2009/0298348 A1 * 12/2009 Lu ..... H01R 13/15 439/668
2010/0055989 A1 * 3/2010 Su ..... H01R 13/6277 439/675
2011/0183536 A1 * 7/2011 Wang ..... H01R 13/7031 439/188
2012/0081102 A1 * 4/2012 Gao ..... H01R 13/641 324/76.11
2013/0114843 A1 * 5/2013 Li ..... H01R 24/58 381/384
2014/0017954 A1 * 1/2014 Zhang ..... H01R 24/58 439/668
2015/0050835 A1 * 2/2015 Ju ..... H01R 12/58 439/607.01
2016/0190753 A1 * 6/2016 DeCola ..... H01R 24/58 439/668

* cited by examiner

MULTISTAGE SIGNAL TRANSMISSION CONNECTOR

BACKGROUND OF THE INVENTION

The present invention relates to a multistage signal transmission connector and, more particularly, to a connector including a plurality of small signal terminals, such that the connector has extra space for more signal terminals for multistage signal transmission.

A signal terminal for a signal transmission connector is generally comprised of a first pin, a second pin, and a ring interconnected between the first pin and the second pin. The first pin is configured to connect with a multi-signal plug, and the second pin is configured to connect with signal lines, forming electrical connection between the multi-signal plug inserted into the connector and the signal lines. However, the above signal terminal having two pins is U-shaped and, thus, occupies a larger space when mounted in the connector, such that the overall volume of the connector is bulky and cannot permit installation of a plurality of signal terminals, which is disadvantageous to multistage signal transmission.

BRIEF SUMMARY OF THE INVENTION

The primary objective of the present invention is to use signal terminals each of which has both an elastic contact portion and an external signal portion and which, when in use, are connected with a multi-signal plug and signal lines. The space occupied by the signal terminals mounted in the connector is reduced to decrease the overall volume of the connector, such that the connector has extra space for more signal terminals, which is suitable for multistage signal transmission.

To achieve the above objective, a multistage signal transmission connector according to the present invention is used to connect with a multi-signal plug and a plurality of signal lines and includes a socket, a signal terminal unit, and an insertion space. The signal terminal unit is mounted to a side of the socket. The socket includes an axial insertion hole into which the multi-signal plug is inserted. The insertion space is surrounded and defined by the signal terminal unit and extends axially to intercommunicate with the axial insertion hole. The signal terminal unit includes a plurality of signal terminals. Each of the plurality of signal terminals includes a body having an elastic contact portion and an external signal portion. The elastic contact portion protrudes inwards into the insertion space and bends. The external signal portion axially extends towards an outer edge of the insertion space and is electrically connected to the elastic contact portion.

In an example, the elastic contact portion of one of the plurality of signal terminals protrudes inwards from a distal end of the body of the one of the plurality of signal terminals into the insertion space and bends. The external signal portion of the one of the plurality of signal terminals is L-shaped, is connected to the body of the one of the plurality of signal terminals, and is located on a side of the body of the one of the plurality of signal terminals opposite to the elastic contact portion of the one of the plurality of signal terminals.

In another example, the elastic contact portion of one of the plurality of signal terminals protrudes inwards from between two ends of the body of the one of the plurality of signal terminals into the insertion space and bends. The external signal portion of the one of the plurality of signal terminals axially extends from a distal end of the body of the one of the plurality of signal terminals towards the outer edge of the insertion space.

In a further example, the elastic contact portion of one of the plurality of signal terminals protrudes inwards from a distal end of the body of the one of the plurality of signal terminals into the insertion space and bends. The external signal portion of the one of the plurality of signal terminals is rectilinear, is connected to the body of the one of the plurality of signal terminals, and has a distal end protruding beyond the body of the one of the plurality of signal terminals.

In an example, the external signal portion is a tab obtained by cutting or punching the body.

The present invention will become clearer in light of the following detailed description of illustrative embodiments of this invention described in connection with the drawings.

DETAILED DESCRIPTION OF THE INVENTION

Figure 1:
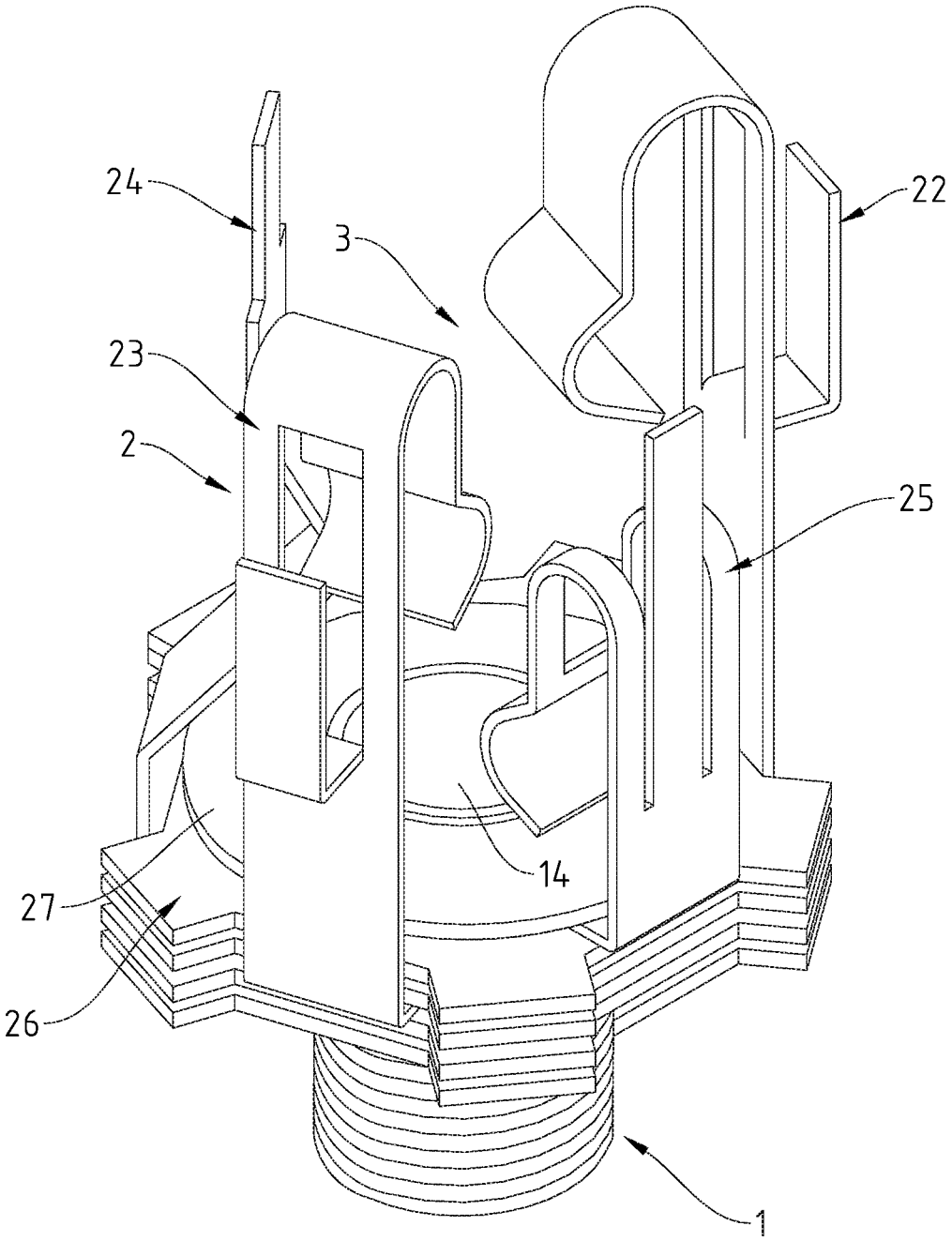
FIG. 1 is a perspective view of a multistage signal transmission connector according to the present invention.
Figure 2:
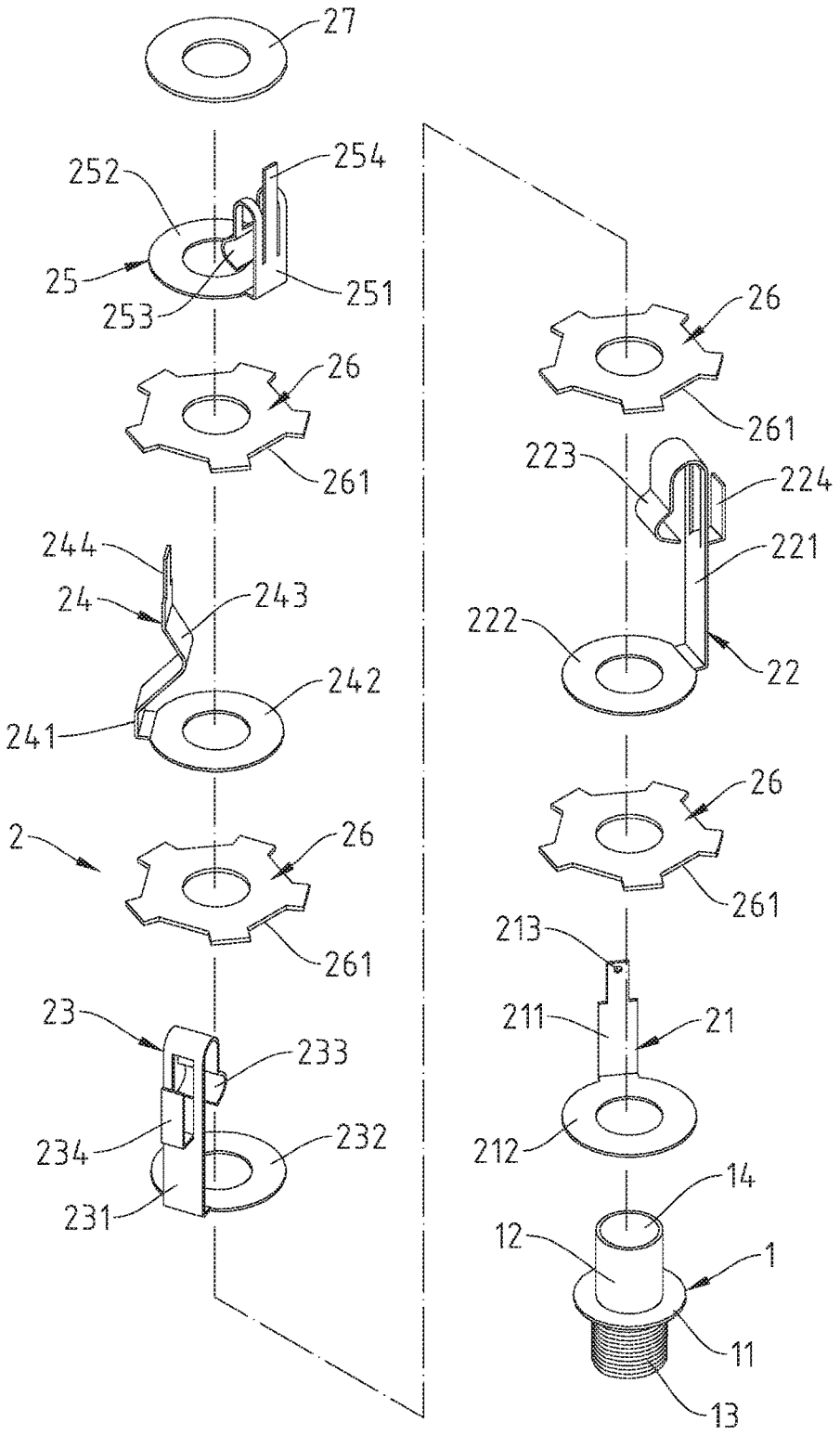
FIG. 2 is an exploded, perspective view of the multistage signal transmission connector of FIG. 1.
Figure 3:
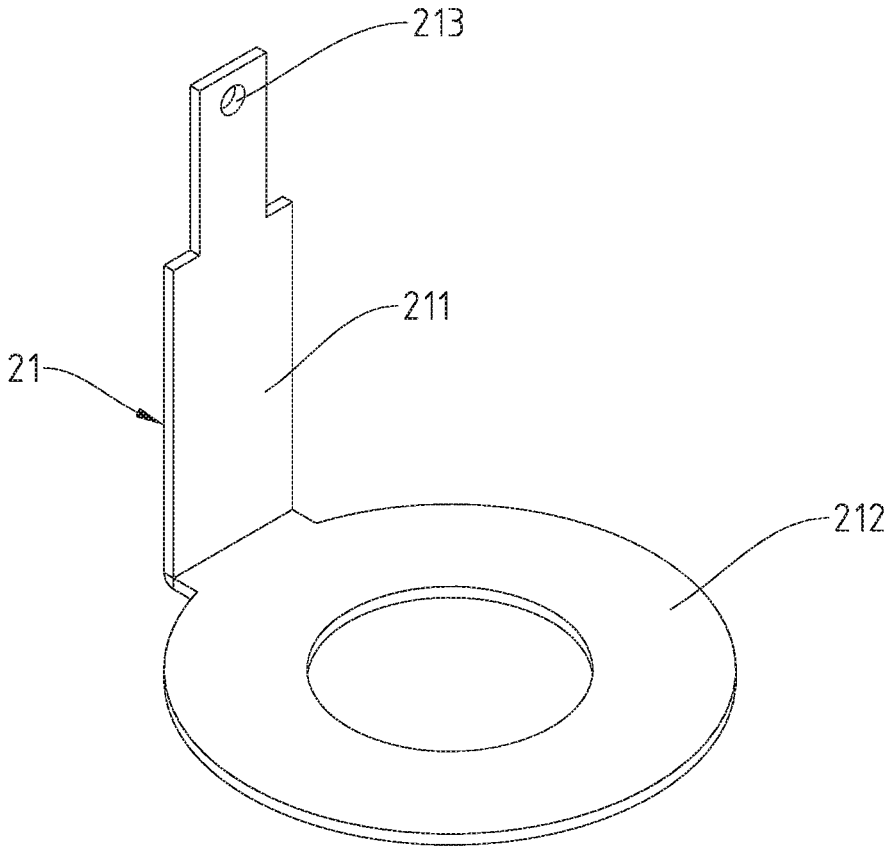
FIG. 3 is a perspective view of a grounding terminal of the multistage signal transmission connector of FIG. 1.

With reference to FIGS. 1-8, a multistage signal transmission connector according to the present invention can be used to connect with a multi-signal plug 5 and a plurality of signal lines (not shown). The multistage signal transmission connector according to the present invention includes a socket 1, a signal terminal unit 2, and an insertion space 3. The signal terminal unit 2 is mounted to a side of the socket 1. The insertion space 3 is surrounded and defined by the signal terminal unit 2.

The socket 1 includes a seat 11, a coupling column 12 disposed on a side of the seat 11, and a fixing column 13 disposed on the other side of the seat 11. An axial insertion hole 14 extends axially through the coupling column 12 and the fixing column 13. The multi-signal plug 5 can be inserted into the axial insertion hole 14. The insertion space 3 is located on a side of the seat 11 adjacent to the coupling column 12 and extends axially to intercommunicate with the axial insertion hole 14.

The signal terminal unit 2 includes a grounding terminal 21, a plurality of signal terminals 22, 23, 24, and 25, a plurality of insulating washers 26, and a fixing washer 27.

The grounding terminal 21 includes a body 211 and a ring 212 connected to a side of the body 211. An external grounding portion 213 is disposed on the body 211 for electrical connection with a grounding wire (not shown) or a terminal female coupler (not shown). The ring 212 is mounted around an outer periphery of the coupling column 12 of the socket 1, is superimposed on the seat 11, and is in electrical connection with the socket 1.

Figure 4:
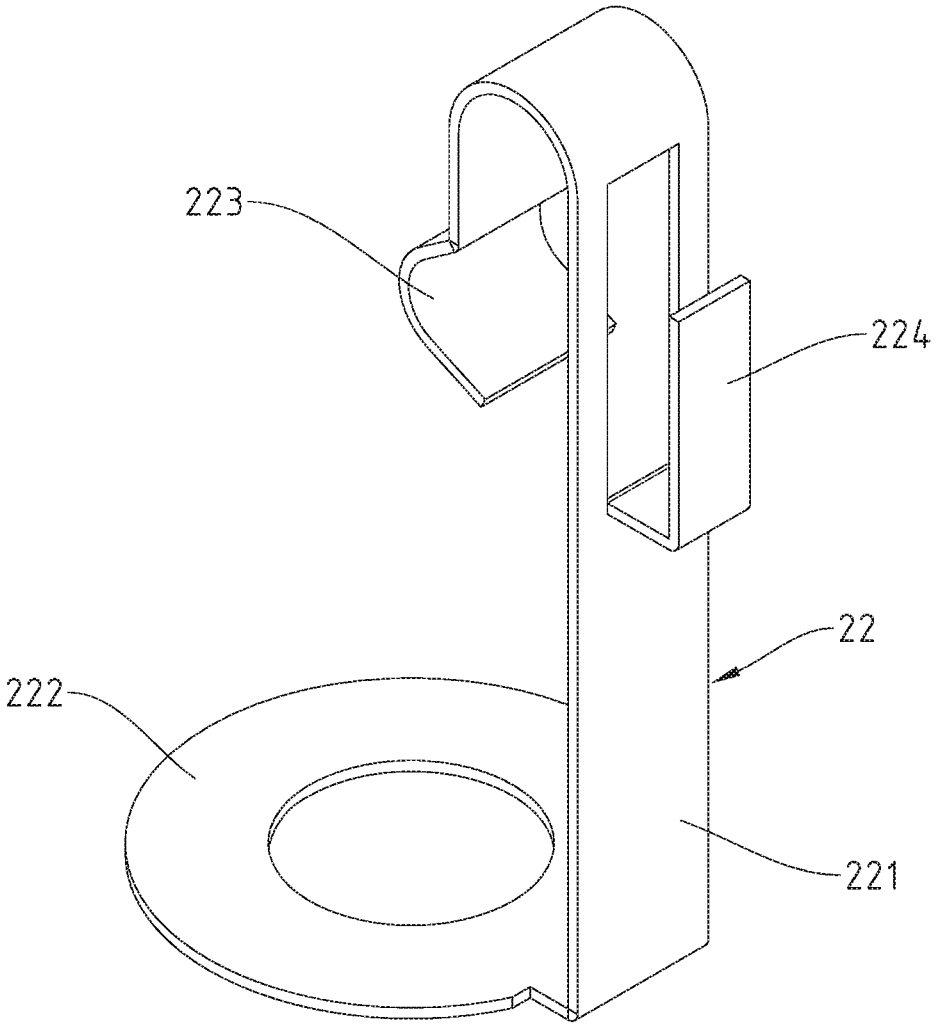
FIG. 4 is a perspective view of a signal terminal of a first type according to the present invention.
Figure 5:
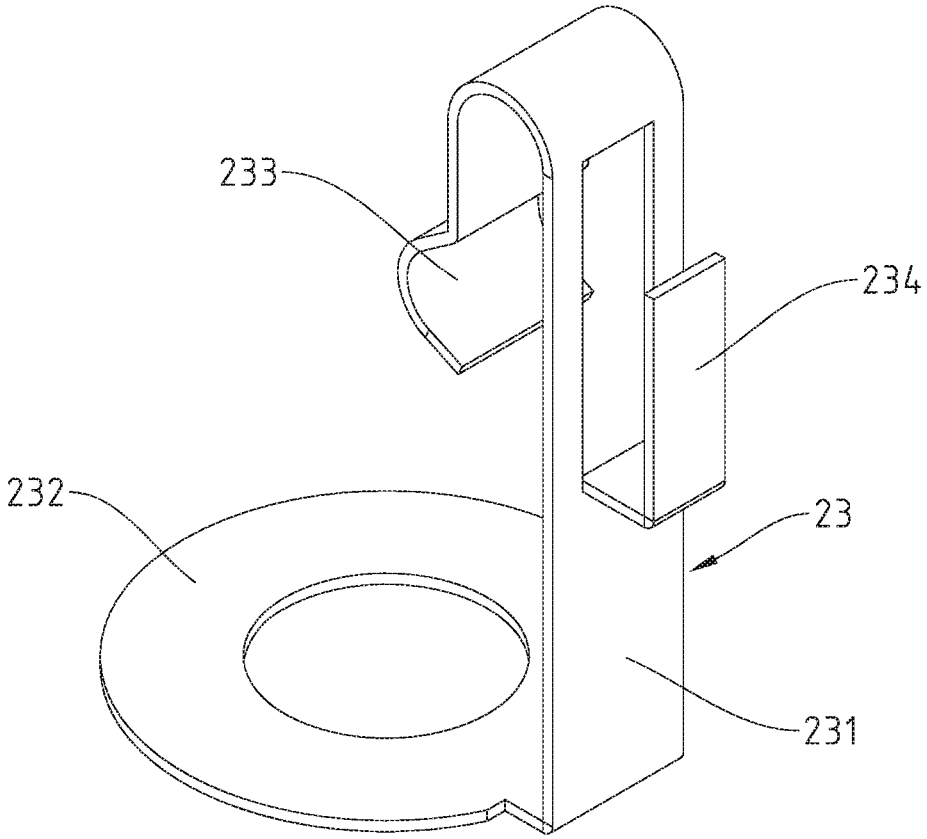
FIG. 5 is a perspective view of a signal terminal of a second type according to the present invention.

The plurality of signal terminals 22, 23, 24, and 25 surrounds the insertion space 3 and has various types. As shown in FIGS. 4 and 5, the signal terminal 22 is of a first type and includes a body 221, a ring 222, an elastic contact portion 223, and an external signal portion 224. The ring 222 is connected to a side of the body 221, is mounted around the coupling column 12 of the socket 1, and is superimposed on the ring 212 of the grounding terminal 21. The elastic contact portion 223 protrudes inwards from a distal end of the body 221 into the insertion space 3 and bends. The external signal portion 224 is configured to connect with a signal wire (not shown) or a terminal female coupler (not shown), is a substantially L-shaped tab obtained by cutting or punching the body 221, and is located on a side of the body 221 opposite to the elastic contact portion 223. The external signal portion 224 axially extends towards an outer edge of the insertion space 3 and is electrically connected to the elastic contact portion 223. Furthermore, the signal terminal 22 of the first type can be modified according to need to form the signal terminal 23 of a second type having a shorter body 231. The signal terminal 23 of the second type is superimposed on top of the signal terminal 22 of the first type to reduce the height of the elastic contact portion 233.

Figure 6:
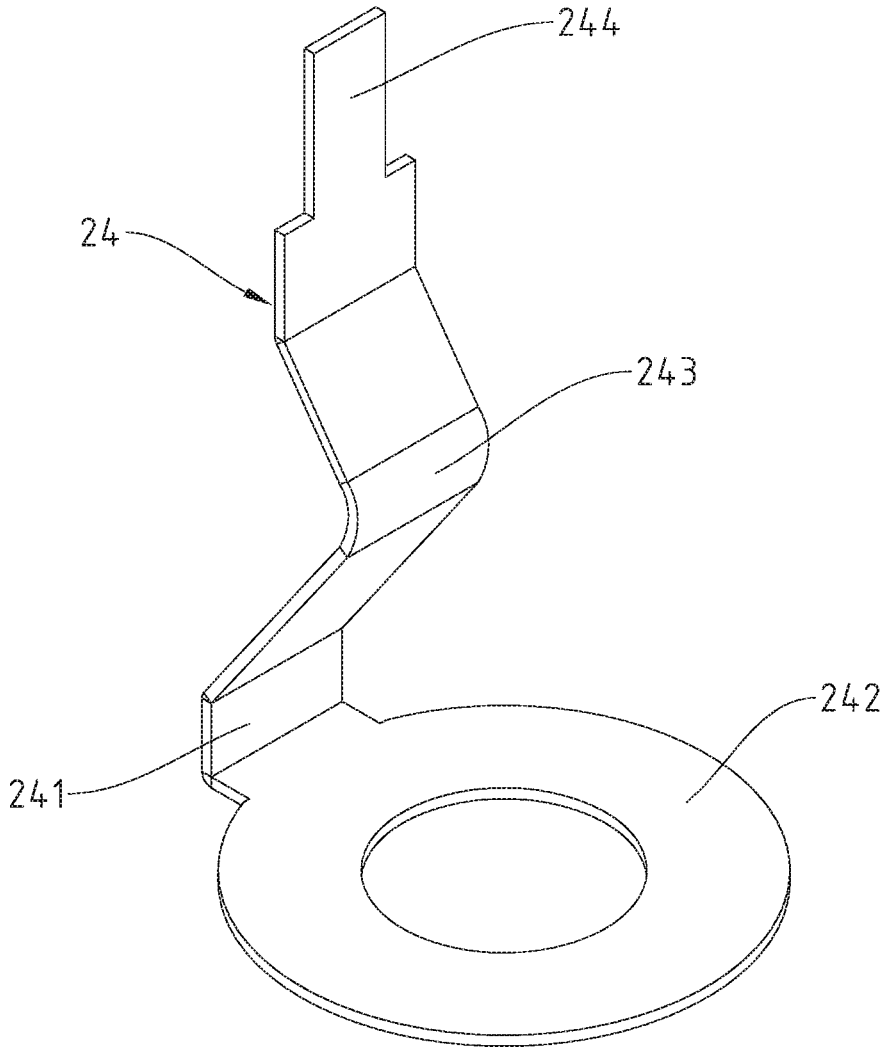
FIG. 6 is a perspective view of a signal terminal of a third type according to the present invention.

With reference to FIG. 6, the signal terminal 24 is of a third type and includes a ring 242 superimposed on the ring 232 of the signal terminal 23 of the second type. The differences between the signal terminal 24 of the third type and the signal terminal 22 of the first type are that the elastic contact portion 243 protrudes inwards from between two ends of the body 241 into the insertion space 3 and bends, and that the external signal portion 244 axially extends from a distal end of the body 241 towards the outer edge of the insertion space 3.

Figure 7:
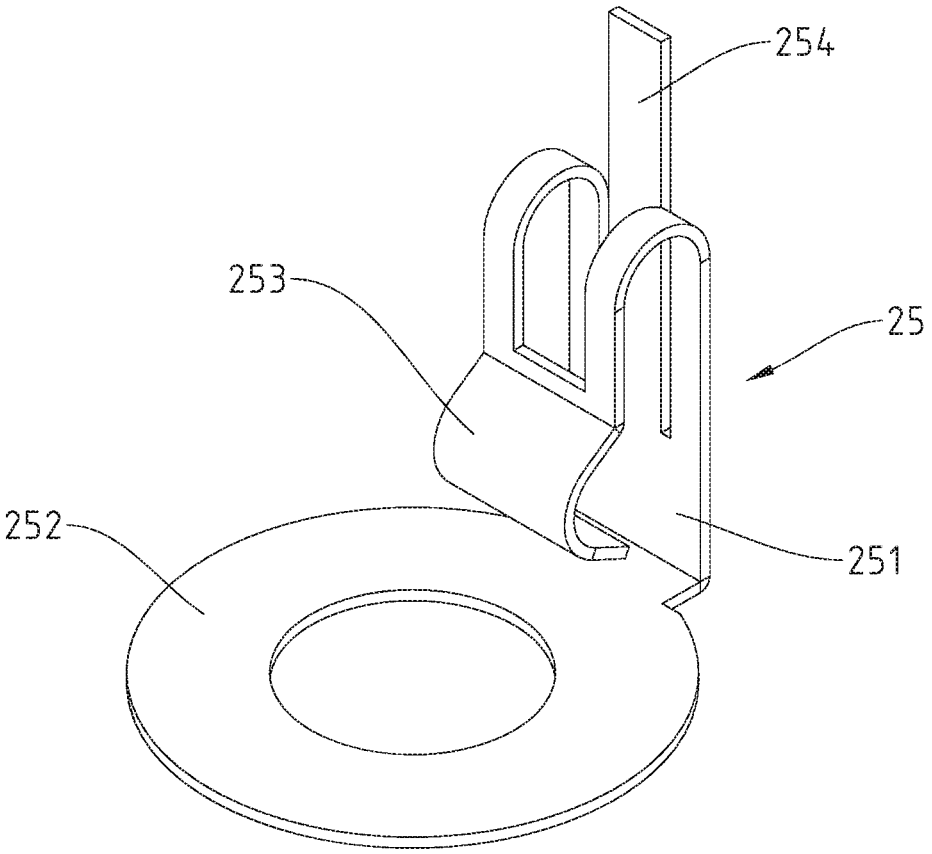
FIG. 7 is a perspective view of a signal terminal of a fourth type according to the present invention.
Figure 8:
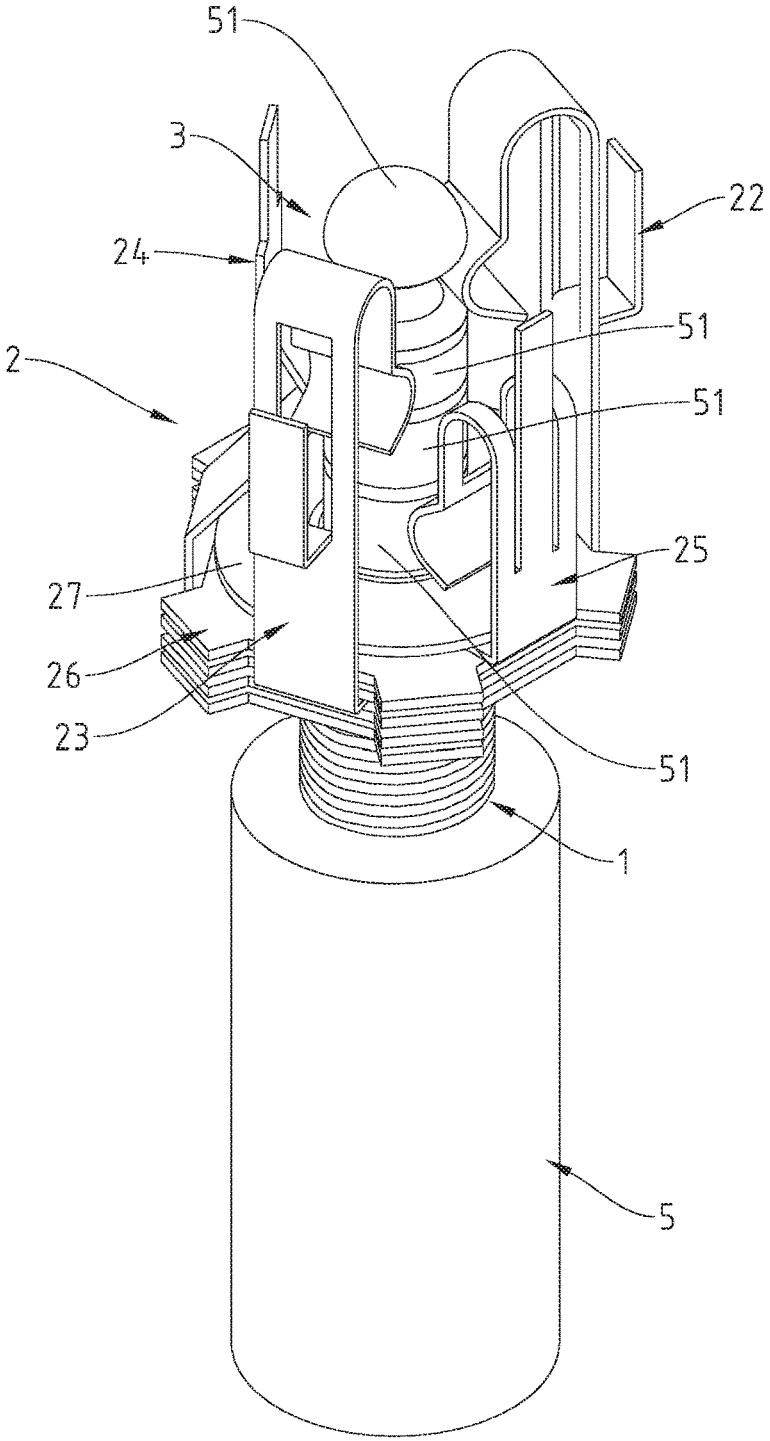
FIG. 8 is a perspective view of the multistage signal transmission connector according to the present invention coupled with a multi-signal plug.
Figure 9:
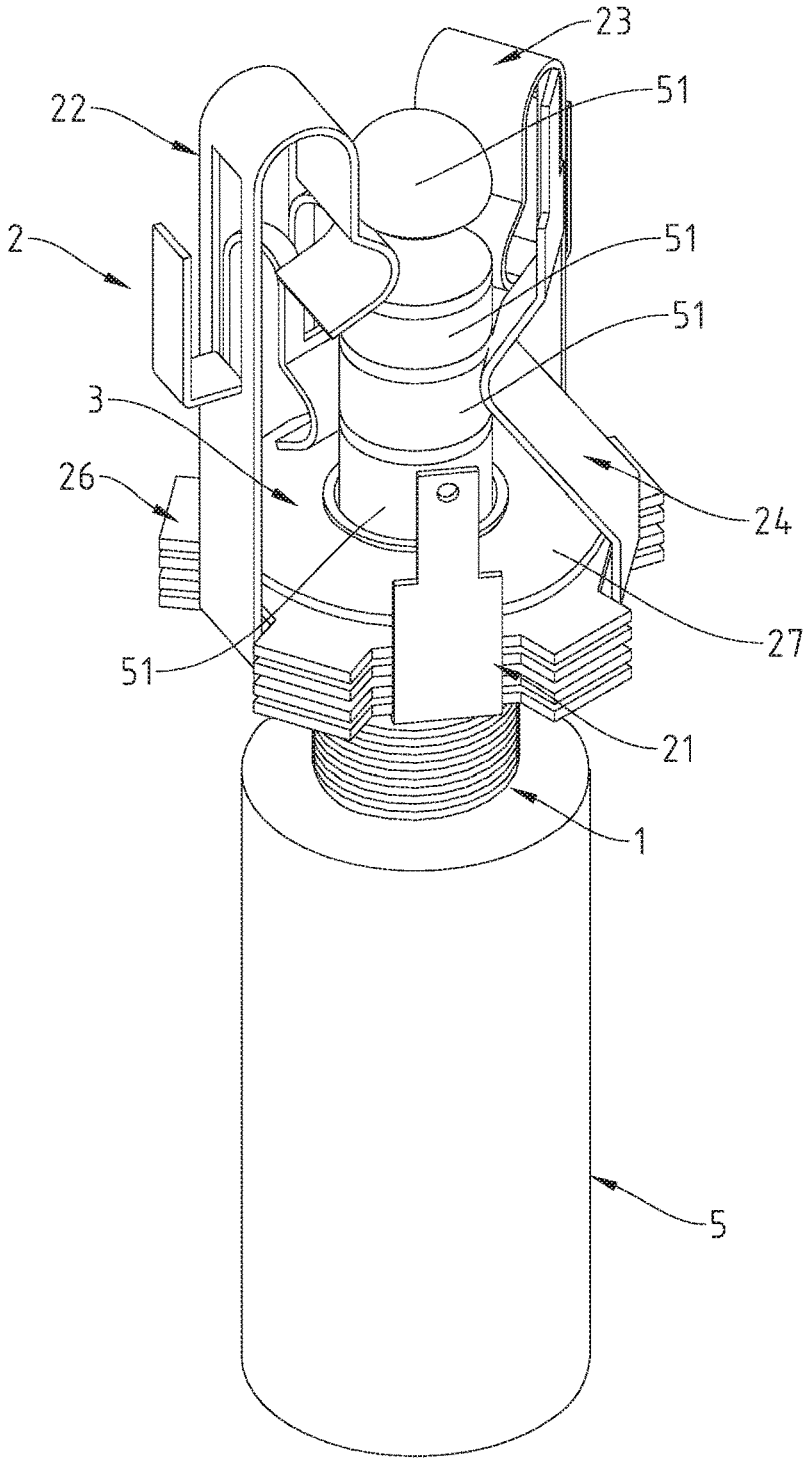
FIG. 9 is another perspective view of the multistage signal transmission connector according to the present invention and the multi-signal plug.
Figure 10:
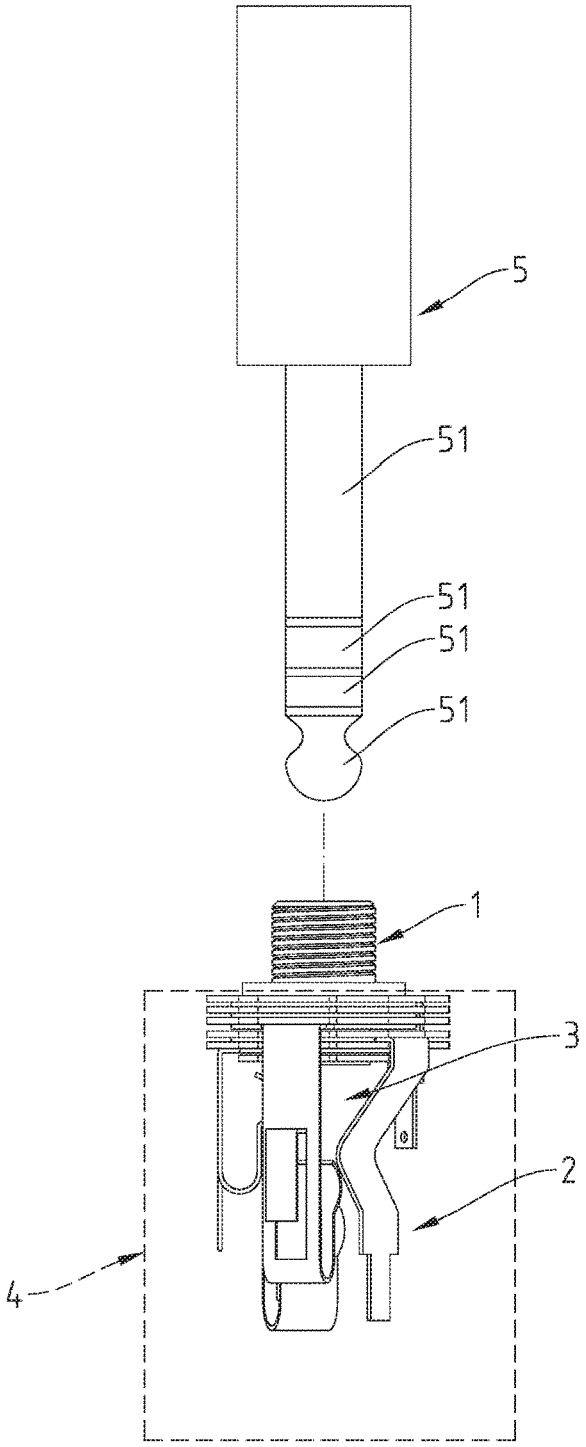
FIG. 10 is a schematic side view illustrating use of the multistage signal transmission connector according to the present invention.

With reference to FIG. 7, the signal terminal 25 is of a fourth type and includes a ring 252 superimposed on the ring 242 of the signal terminal 24 of the third type. The differences between the signal terminal 25 of the fourth type and the signal terminal 22 of the first type are that the elastic contact portion 253 protrudes inwards from a distal end of the body 251 into the insertion space 3 and bends, and that the external signal portion 254 is a rectilinear tab extending axially towards the outer edge of the insertion space 3 and obtained by cutting or punching the body 251, with the external signal portion 254 having a distal end protruding beyond the body 251.

Thus, the signal terminal unit 2 includes the elastic contact portions 223, 233, 243, and 253 at different heights. The external signal portions 224, 234, 244, and 254 can be modified to have a rectilinear or curved shape or other geometric shape. Of course, the external signal portion 224, 234, 244, 254 can be connected to the side of the body 221, 231, 241, 251 opposite to the elastic contact portion 223, 233, 243, 253 by welding, riveting, or other provisions.

The plurality of insulating washers 26 is annular and is respectively mounted between the grounding terminal 21, the plurality of signal terminals 22, 23, 24, and 25 and the fixing washer 27. The plurality of insulating washers 26 is mounted around the outer periphery of the coupling column 12 of the socket 1. Each of the plurality of insulating washers 26 includes a plurality of alignment grooves 261 in an outer periphery thereof. The body 211 of the grounding terminal 21 and the bodies 221, 231, 241, and 251 of the plurality of signal terminals 22, 23, 24, and 25 are respectively located in and restrained by the plurality of alignment grooves 261.

The fixing washer 27 is annular, is mounted around the outer periphery of the coupling column 12 of the socket 1, and is spaced from the plurality of insulating washers 26. The fixing washer 27 is superimposed on and abuts against a face of the ring 252 of the signal terminal 25 of the fourth type. Then, a distal end of the coupling column 12 is riveted to fix the plurality of signal terminals 22, 23, 24, and 25.

With reference to FIGS. 2 and 8-10, when in use, the socket 1 is installed on an electronic device 4, and the fixing column 13 faces outwards. The multi-signal plug 5 is axially inserted into the axial insertion hole 14 at the fixing column 13. The signal connecting portions 51 of the multi-signal plug 5 respectively contact with the elastic contact portions 223, 233, 243, and 253 of the signal terminal unit 2 and are, thus, electrically connected to the signal lines (not shown), achieving multistage signal transmission.

Thus, the multistage signal transmission connector according to the present invention can solve the problems and drawbacks of the prior art. The critical technique is that the multistage signal transmission connector uses signal terminals 22, 23, 24, and 25 each of which has both an elastic contact portion 223, 233, 243, 253 and an external signal portion 224, 234, 244, 254 and which, when in use, are connected with the multi-signal plug 5 and the signal lines or their terminal female couplers. The space occupied by the signal terminals 22, 23, 24, and 25 mounted in the connector is reduced to decrease the overall volume of the connector, such that the connector has extra space for more signal terminals 22, 23, 24, and 25, which is suitable for multistage signal transmission.

Although specific embodiments have been illustrated and described, numerous modifications and variations are still possible without departing from the scope of the invention. The scope of the invention is limited by the accompanying claims.

The invention claimed is:

1. A multistage signal transmission connector for connecting with a multi-signal plug and a plurality of signal lines, comprising a socket, a signal terminal unit, and an insertion space, wherein the signal terminal unit is mounted to a side of the socket, wherein the socket includes an axial insertion hole into which the multi-signal plug is inserted, wherein the insertion space is surrounded and defined by the signal terminal unit and extends axially to intercommunicate with the axial insertion hole, wherein:

the signal terminal unit includes a plurality of signal terminals, wherein each of the plurality of signal terminals includes a body having an elastic contact portion and an external signal portion, wherein the elastic contact portion protrudes inwards into the insertion space and bends, wherein the external signal portion axially extends towards an outer edge of the insertion space and is electrically connected to the elastic contact portion, wherein the elastic contact portion of one of the plurality of signal terminals protrudes inwards from a distal end of the body of the one of the plurality signal terminals into the insertion space and bends, and wherein the external signal portion of the one of the plurality signal terminals is rectilinear, is connected to the body of the one of the plurality signal terminals, and has a distal end protruding beyond the body of the one of the plurality signal terminals.

2. The multistage signal transmission connector as claimed in claim 1, wherein the elastic contact portion of another of the plurality signal terminals protrudes inwards from a distal end of the body of the another of the plurality signal terminals into the insertion space and bends, and wherein the external signal portion of the another of the plurality signal terminals is L-shaped, is connected to the body of the another of the plurality signal terminals, and is located on a side of the body of the another of the plurality signal terminals opposite to the elastic contact portion of the another of the plurality signal terminals.

3. The multistage signal transmission connector as claimed in claim 1, wherein the elastic contact portion of another of the plurality signal terminals protrudes inwards from between two ends of the body of the another of the plurality signal terminals into the insertion space and bends, and wherein the external signal portion of the another of the plurality signal terminals axially extends from a distal end of the body of the another of the plurality signal terminals towards the outer edge of the insertion space.

4. The multistage signal transmission connector as claimed in claim 1, wherein the external signal portion of the one of the plurality signal terminals is a tab.

* * * * *